United States Patent [19]

Fulton et al.

[11] Patent Number: 4,731,616

[45] Date of Patent: Mar. 15, 1988

[54] ANTENNA HORNS

[76] Inventors: David A. Fulton, 3 Pilgrim Rd., Watertown, Mass. 02172; Christopher L. Slotta, 8 Daniel Dr., Bellingham, Mass. 02019

[21] Appl. No.: 740,876

[22] Filed: Jun. 3, 1985

[51] Int. Cl.[4] ..... H01Q 13/02

[52] U.S. Cl. ..... 343/786; 343/781 R

[58] Field of Search ..... 343/786, 772, 779, 781 R

[56] References Cited

U.S. PATENT DOCUMENTS

| | | | |
|---|---|---|---|
| 3,662,393 | 5/1972 | Cohn | 343/786 |
| 3,680,145 | 7/1972 | Beguin | 343/786 |
| 4,122,446 | 10/1978 | Hansen | 343/786 |

*Primary Examiner*—William L. Sikes
*Assistant Examiner*—Michael C. Wimer
*Attorney, Agent, or Firm*—Donald Brown

[57] ABSTRACT

Antenna horns for use as part of antenna system such as an offset parabolic antenna system. The horns of this antenna include a plurality of sections which enable the propagation of both the $TE_{1,1}$ mode and the $TM_{1,1}$ mode.

8 Claims, 8 Drawing Figures

ANTENNA HORNS

BACKGROUND OF THE INVENTION

This invention is directed at antenna systems useful for capturing TV signals transmitted from satellites or transmitting microwave signals to satellites and is more particularly directed to a new and improved dual mode horn used in conjunction with a parabolic reflector (dish) to receive signals focused at the horn aperture by the reflector or transmit signals towards the reflector.

Satellite TV systems have become more prevalent as additional satellites have been placed in orbit. Reflector horns and receivers pull in signals broadcast by satellites at more than 22,000 miles away. It has been reported that about one million home antennas are now aimed at a band of satellites in geostationary orbit above the equator.

These are primarily C-band satellites, that is they transmit in the 3.7 to 4.2 gigahertz ($GH_z$) waveband. There are also some satellites operating in the KU BAND i.e., at a frequency of 11.7 to 12.7 $GH_z$. These satellites serve as low-power microwave repeater station.

The antenna systems used today are referred to as TVRO (TV-Receive Only) antennas and comprise a dish (reflector), a horn for receiving the reflected energy focused by the antenna towards the horn aperture and a low noise converter coupled to one end of the horn. Signals from the antenna are suitably amplified and feed to the users TV receiver.

A more recent improvement in such systems is the use of a new and improved offset parabolic antenna system which has significant advantages. Such offset parabolic systems substantically eleminates snow loading as well as substantically eleminating shadows cast by axisymmetrical parabolic designs and thus the adverse effect of the reflector on the horn is substantially reduced. In order to fully gain the benefits of an offset parabolic dish antenna, it became apparent that conventional horns would not be satisfactory and therefore a new and improved horn was needed. This invention provides such a unique dual mode conical horn to permit the benefits of an offset parabolic antenna system using e.g., the parabolic antenna dish (reflector) sold by Northern Satellite Corporation of 103 South Street, Hopkinton, Mass. 01748, to be realized. It should be understood that the horn of this invention can operate equally well to receive or transmit in conjunction with a parabolic dish (reflector) and is particularly advantageous when used in conjunction with a small focal length reflector because it can be made quite small in physical size comparison with the conventional single mode horn which could be used.

The horns of this invention may conveniently be constructed of a die cast zinc alloy or other metal materials.

BRIEF STATEMENT OF THE INVENTION

The horns of this invention are particularly suitable for use in satellite antenna systems of the type which are known as offset parabolic antenna systems.

The horns of this invention, generally termed a dual mode horn, include hollow sections which are coupled together in a manner to enable the propagation of both $TE_{1,1}$ and $TM_{1,1}$ waves when transmitting.

DETAILED DESCRIPTION OF THE INVENTION

Figure 1:
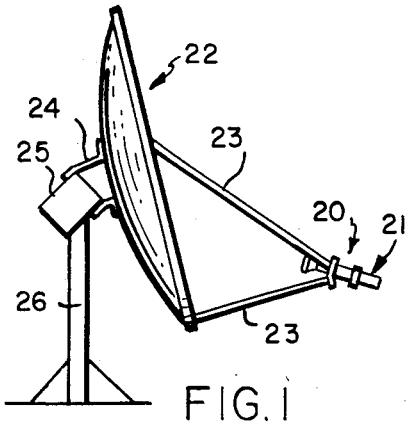
FIG. 1 is a side view illustrating the horn of this invention as part of an offset parabolic antenna system.

Reference should now be had to FIGS. 1 to 4 for a description of the horn of this invention which is suitable for use at frequences of 11.7 to 12.7 $GH_z$ (KU BAND). In FIG. 1 there is shown at 20 a horn of this invention coupled to a conventional low noise block converter 21 for receiving the energy collected by the horn 20 which had been reflected and focused by the parabolic antenna 22. Struts 23 coupled to the antenna 22 support the horn 20 and converter 21 in what is termed an offset parabolic antenna system configuration. Support members 24, 25 and 26 are used to position the antenna system on the roof of a house or the like and point the reflector 22 at a satellite. The energy from the converter is ultimately fed through conventional electronics to provide TV signals for display inside the users building.

Figure 2:
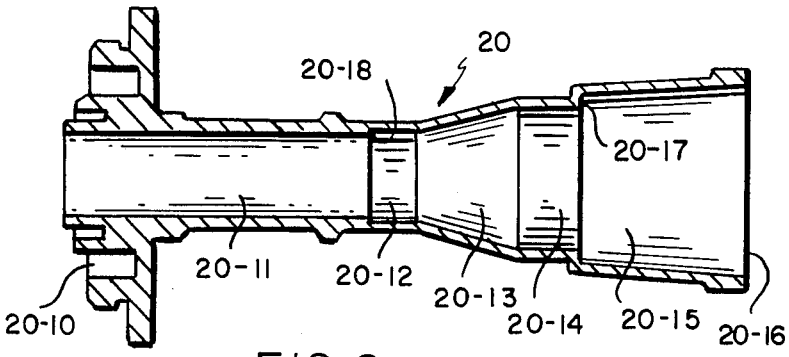
FIG. 2 is a sectional view of one embodiment of the horn of this invention for use at frequency of 11.7 to 12.2 $GH_z$.
Figure 3:
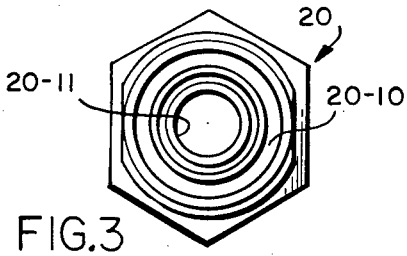
FIG. 3 is an end view of the horn of FIG. 2 taken from the left of FIG. 2 having a threaded end type of connection.
Figure 4:
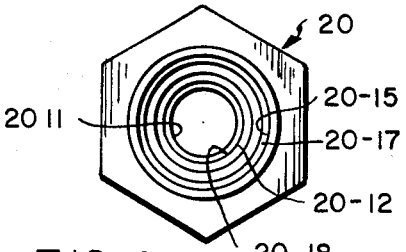
FIG. 4 is an end view of the horn of FIG. 2 taken from the right of FIG. 2.

In FIGS. 2 to 4 there is shown the preferred horn 20 of this invention in more detail. It should be understood that the horn of this invention suitably coupled to a transmitter may also be used to transmit energy towards the antenna reflector 22 and thus the reflector 22 can be used to transmit signals as well as receive signals. At 20-10 the horn 20 is provided with an interface flange with an RF choke and O-ring groove, all of which are conventional means used for the coupling to a low noise block converter. The horn preferably includes a plurality of sections 20-11, 20-12, 20-13, 20-14 and 20-15. The horn is preferably made of metal such as a zinc alloy AG40A. Section 20-11 is a circular cross section waveguide of about 2.175 inches and an inside diameter of about 0.622 inches throughout. Section 20-11 may be longer if desired. The section 20-11 acts as a bandpass filter to pass 11.7 $GH_z$ to 12.2 $GH_z$ microwave signal and reject signal frequencies below that in order to prevent interference by the low noise block converter local oscillator which is at 10.7 $GH_z$.

Coupled as shown to section 20-11 is section 20-12. Waveguide section 20-12 is of circular cross section and has an inside diameter throughout of about 0.645 inches and a length of about 0.385 inches. Section 20-12 function is to match section 20-11 to the waveguide section 20-13 with little or no contributing voltage standing wave ratio (VSWR).

Smooth tapered waveguide section 20-13 is of circular cross section and of a length of about 0.750 inches and has a smaller inside diameter of about 0.645 inches where it mates with section 20-12 and has a larger inside diameter of about 1.020 inches at its opposite end. The taper is gradual i.e., not irregular between opposite ends of this section. Waveguide section 20-14 functions to enable the $TE_{1,1}$ wave to pass into mode section 20-15 where the shoulder (step) shown at 20-17 causes the launching of the $TM_{1,1}$ wave. Section 20-14 is of circular cross section and has an inside diameter of about 1.020 inches throughout and a length of about 0.450 inches.

A smooth tapered waveguide section is shown at 20-15 and functions to allow the transmission of the waves $TE_{1,1}$ and $TM_{1,1}$ to pass to the horn aperature 20-16 with little or no contributing VSWR and is of a length to control the primary pattern beam width in the "H" plane (horizontal polarization). The waveguide section 20-15 is of circular cross section a length of about 1.250 inches and has a smaller inside diameter of about 1.200 inches at one end and at the opposite end which forms the aperature 20-16 is of an inside diameter of about 1.350 inches. The aperature 20-16 function is to control the E plane (vertical polarization) beam width (primary). The section 20-15 and the aperature 20-16 are constructed so that both waves $TE_{1,1}$ and $TM_{1,1}$ arrive at the aperature opening at the same time over the frequency band of 11.7 $GH_z$ to 12.2 $GH_z$ when transmitting.

As shown positioned at the interface of sections 20-14 and 20-15 there is a shoulder (step) 20-17 which is substantially perpendicular to the inner cylindrical surface of section 20-14. The shoulder generates the $TM_{1,1}$ wave (mode) when the $TE_{1,1}$ wave passes from section 20-14 into 20-15. The width of shoulder 20-17 is defined by the difference in the inside diameter of section 20-14 (which is about 1.02 inches) and the smaller inside diameter of section 20-15 (which is about 1.20 inches) and is about 0.18 inches in width. Between sections 20-11 and 20-12 a transistion (step) shoulder 20-18 substantially perpendicular to the inner surfaces of the sections 20-11 and 20-12 is shown and is about 0.023 inches.

Figure 5:
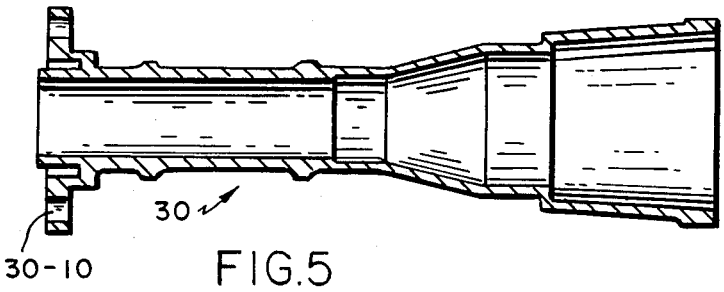
FIG. 5 is a sectional view of a horn of this invention having an end construction for a clamped type of connection.

Reference should now be had to FIG. 5 which shows substantially the same horn 30 as in FIGS. 2 to 4 with the same waveguide dimensions except that a different coupling is provided at 30-10 to accomodate a clamped type connection to a converter.

It should be understood that sections 20-11 to 20-14 are shown as having shapes which produce high efficiencies and isolation of unwanted frequencies, however, if such improved performance is not desired, one could still use a major part of the invention which includes the step 20-17, the section 20-15 and the aperature 20-16 and use e.g., a tapered feed transistion coupled to a circular waveguide.

Figure 6:
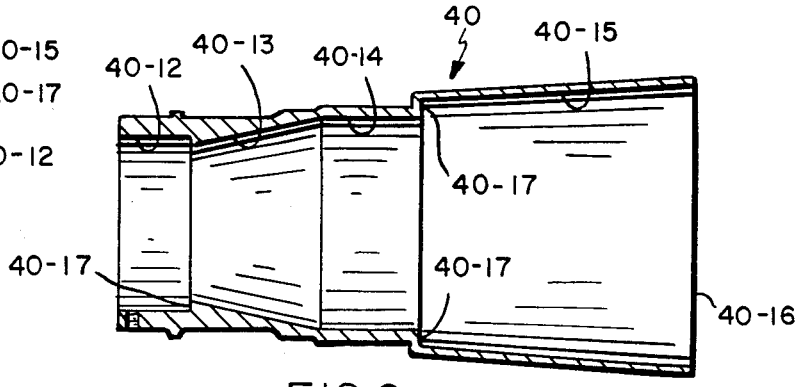
FIG. 6 is a sectional view of a horn of this invention for use at 3.7 to 4.2 $GH_z$.
Figure 7:
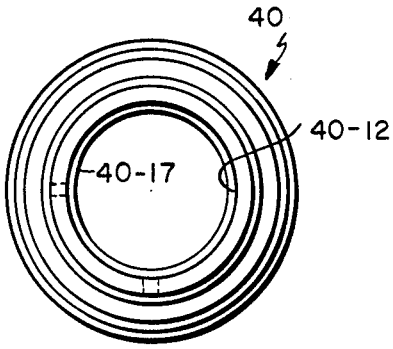
FIG. 7 is an end view of the horn taken from the left of FIG. 6.
Figure 8:
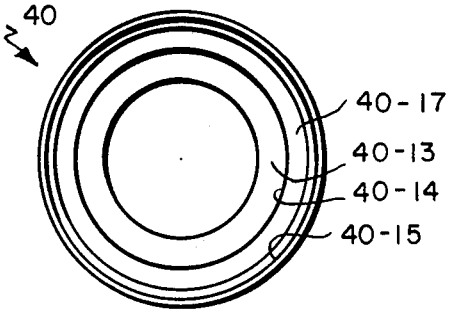
FIG. 8 is an end view of the horn taken from the right of FIG. 6.

At this time, reference is made to FIGS. 6 to 8 for illustration of a horn for use at frequencies in the band namely 3.7 to 4.2 $GH_z$. This antenna horn of FIGS. 6 to 8 is particularly useful in an offset parabolic antenna system as shown in FIG. 1. The horn is shown at 40 and comprises four sections 40-12, 40-13, 40-14, 40-15 and an aperature 40-16 as shown. The sections 40-11 to 40-14 and the aperature 40-15 function in the same way as corresponding shaped sections of the horn of FIGS. 2 to 4 at higher frequencies e.g., about 4.0 to 4.2 $GH_z$ and lower frequencies 3.7 to about 4.0 $GH_z$ only the $TE_{1,1}$ wave is propogated.

In these figures, waveguide section 40-12 has an inside diameter of about 2.506 inches throughout and a length of about 1.139 inches. Smooth tapered waveguide section 40-13 has a smaller inside diameter of about 2.330 inches and a length of about 1.876 inches and a larger outside diameter of about 3.114 inches. Section 40-13 is a counterbore in which to mount a conventional polarizer. A shoulder (step) 40-18 is positioned between sections 40-12 and 40-13 and is of a width of about 0.176 inches. Waveguide section 40-14 has an inside diameter of about 3.114 inches throughout and a length of about 1.425 inches. Smooth tapered waveguide section has a smaller inside diameter of about 3.663 inches and a larger inside diameter at the aperature of about 4.20 inches and a length of about 4.060 inches. A washer shaped shoulder (step) 40-17 of about 0.549 inches is positioned at the interface between sections 40-14 and 40-15.

It should be understood that the horns of this invention may be used for both transmitting and receiving while the description herein has been in terms of transmitting, it is understood for receiving the incoming signals pass through the horn in the reverse direction.

We claim:

1. An antenna horn comprising:

A. a first hollow waveguide section which is internally smoothly tapered and is of a circular cross section having a larger inside diameter of about 1.350 inches at one end which forms the aperature of the horn thereof and smoothly tapering down to an inside diameter of about 1.20 inches at the opposite end, said section having a length of about 1.250 inches and a step of a width of about 0.18 inches at the end opposite the aperature;

B. a second hollow waveguide section which has an inside diameter of about 1.020 inches throughout and is coupled to the end of the first section having the step, said second section having a length of about 0.450 inches;

C. a third hollow waveguide section which is smoothly tapered and is of a circular cross section with a larger inside diameter of about 1.020 inches at the one end which is coupled to said second section and an inside diameter of about 0.645 inches at the other end, said third section having a length of about 0.750 inches, and D. a fourth hollow waveguide section which has an inside diameter of about 0.645 inches throughout and a length about 0.385 inches, said fourth section coupled to the smaller inside diameter end of said third section.

2. The horn of claim 1 including means for coupling said horn to a converter.

3. An antenna horn comprising:

A. a first hollow waveguide section which is tapered and is of a circular cross section having a larger inside diameter of about 1.350 inches at one end which acts as the aperature of the horn and smoothly tapering down to an inside diameter of about 1.20 inches at the opposite end, said section having a length of about 1.250 inches and a step of about 0.18 inches at the end opposite the aperature;

B. a second hollow waveguide section which has an inside diameter of about 1.020 inches throughout and is coupled to the end of first section end having the smaller inside diameter, said second section having a length of about 0.450 inches;

C. a third hollow waveguide section which is smoothly tapered and is of a circular cross section having a larger inside diameter of about 1.020 inches at the one end which is coupled to said second section coupled to said first section and an inside diameter of about 0.645 inches at the other end, said third section having a lengeth of about 0.750 inches;

D. a fourth hollow waveguide section which an inside diameter of about 0.645 inches and a length of about 0.385 inches, said fourth section coupled to the smaller inside diameter end of said third section and E. a fifth hollow waveguide section which has an inside diameter of about 0.622 inches and a length of about 2.175 inches or greater coupled to said fourth section.

4. The antenna horn of claim 3 wherein said fifth section includes means for coupling said horn to a converter.

5. An antenna horn comprising:

A. a first hollow waveguide section which is smoothly internally tapered and is of a circular cross section having a larger inside diameter of about 4.20 inches at one end which acts as the aperature of the horn thereof and tapering down to an inside diameter of about 3.663 inches at the opposite end section having a length of about 4.060 inches and a step of about 0.549 inches at the end opposite the aperature;

B. a second hallow waveguide section which has an inside diameter of about 3.114 inches throughout and is coupled to the end of the first section having the smaller inside diameter, said second section having a length of about 1.425 inches;

C. a third hollow waveguide section which is smooth tapered and is of a circular cross section having a larger inside diameter of about 3.114 inches at the one end, which is coupled to said second section opposite said end of said second section coupled to said first section, and a smaller inside diameter of about 2.330 inches at the other end, said third section having a length of about 1.876 inches, and D. a fourth hollow waveguide section which has an inside diameter of about 2.506 inches throughout and a length of about 1.139 inches, said fourth section coupled to the smaller inside diameter end of said third section.

6. An antenna horn according to claim 5 wherein said fourth section includes means for coupling a converter thereto.

7. An antenna horn comprising:

A. a first hollow waveguide section which is internally smoothly tapered and is of a circular cross section having a larger inside diameter of about 1.350 inches at one end which forms the aperature of the horn thereof and smoothly tapering down to an inside diameter of about 1.20 inches at the opposite end, said section having a length of about 1.250 inches and a step of a width of about 0.18 inches at the end opposite the aperature;

B. a second hollow waveguide section which has an inside diameter of about 1.020 inches throughout and is coupled to the end of the first section having the step, said second section having a length of about 0.450 inches; and C. a third hollow waveguide section which is smoothly tapered and is of a circular cross section with a larger inside diameter of about 1.020 inches at the one end which is coupled to said second section and an inside diameter of about 0.645 inches at the other end, said third section having a length of about 0.750 inches.

8. An antenna system comprising the horn of claims 1, 2, 3, 4, 5, 6, or 7 and a reflector for focusing received signals at the horn aperature or reflecting signals transmitted from the horn aperature.

* * * * *